US006802215B1

(12) United States Patent
Boucher et al.

(10) Patent No.: US 6,802,215 B1
(45) Date of Patent: Oct. 12, 2004

(54) APPARATUS FOR WEIGHT ON BIT MEASUREMENTS, AND METHODS OF USING SAME

(75) Inventors: Marcel Boucher, Houston, TX (US); Aaron Schen, Houston, TX (US); Craig Ivie, Spring, TX (US); Brian Peter Jarvis, Chipping Sodbury (GB)

(73) Assignee: ReedHyealog L.P., Houston, TX (US)

( * ) Notice: Subject to any disclaimer, the term of this patent is extended or adjusted under 35 U.S.C. 154(b) by 0 days.

(21) Appl. No.: 10/605,627

(22) Filed: Oct. 15, 2003

(51) Int. Cl.[7] ..... E21B 44/00
(52) U.S. Cl. ..... 73/152.48; 73/152.59
(58) Field of Search ..... 73/152.48, 152.49, 73/152.59

(56) References Cited

U.S. PATENT DOCUMENTS

| | | | | |
|---|---|---|---|---|
| 3,968,473 A | | 7/1976 | Patton et al. | |
| 4,120,198 A | | 10/1978 | Tanguy et al. | |
| 4,359,898 A | | 11/1982 | Tanguy et al. | |
| 4,597,289 A | * | 7/1986 | Obrecht | 73/152.48 |
| 4,608,861 A | * | 9/1986 | Wachtler et al. | 73/152.48 |
| 4,805,449 A | * | 2/1989 | Das | 73/152.48 |
| 4,811,597 A | * | 3/1989 | Hebel | 73/152.48 |
| 4,821,563 A | * | 4/1989 | Maron | 73/152.48 |
| 4,875,530 A | | 10/1989 | Frink et al. | |
| 4,928,521 A | | 5/1990 | Jardine | |
| 4,958,517 A | * | 9/1990 | Maron | 73/152.48 |
| 5,305,836 A | | 4/1994 | Holbrook et al. | |
| 5,386,724 A | * | 2/1995 | Das et al. | 73/152.59 |
| 5,842,149 A | | 11/1998 | Harrell et al. | |
| 5,881,310 A | | 3/1999 | Airhart et al. | |
| 6,021,377 A | | 2/2000 | Dubinsky et al. | |
| 6,068,394 A | | 5/2000 | Dublin, Jr. | |
| 6,216,533 B1 | | 4/2001 | Woolson et al. | |
| 6,233,524 B1 | | 5/2001 | Harrell et al. | |
| 6,343,515 B1 | | 2/2002 | Dodson | |
| 6,427,530 B1 | | 8/2002 | Krueger et al. | |
| 6,547,016 B2 | | 4/2003 | Wassell | |
| 6,684,949 B1 | * | 2/2004 | Gabler et al. | 166/250.01 |

* cited by examiner

*Primary Examiner*—Hezron Williams
*Assistant Examiner*—John Fitzgerald
(74) *Attorney, Agent, or Firm*—Jeffery E. Daly; J. Mike Amerson; Williams, Morgan & Amerson, P.C.

(57) ABSTRACT

The present invention is generally directed to a tool for obtaining weight-on-bit (WOB) measurements and methods of using such a tool. In one illustrative embodiment the tool comprises a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge operatively coupled to the mounting face above the region of approximately zero axial strain. In another illustrative embodiment, the method comprises providing a weight-on-bit measurement tool comprised of a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge coupled to the mounting face above the region of approximately zero axial strain. The method further comprises positioning the tool in a drill string comprised of a drill bit, drilling a well bore with the drill string, and obtaining weight-data-on-bit measurement data using the weight-on-bit strain gauge in the tool.

49 Claims, 4 Drawing Sheets

APPARATUS FOR WEIGHT ON BIT MEASUREMENTS, AND METHODS OF USING SAME

BACKGROUND OF INVENTION

1. Field of the Invention

The present invention is generally directed to tools and methods employed to obtain downhole measurements regarding the drilling of a well bore, and, more particularly, to a tool for obtaining weight-on-bit (WOB) measurements and methods of using such a tool.

2. Description of the Related Art

Oil and gas wells are formed by a rotary drilling process. To that end, a drill bit is mounted on the end of a drill string which may be very long, e.g., several thousand feet. At the surface, a rotary drive mechanism turns the drill string and the attached drill bit at the bottom of the hole. In some cases, a downhole motor may provide the desired rotation to the drill bit. During drilling operations, a drilling fluid (so-called drilling mud) is pumped through the drill string and back up-hole by pumps located on the surface. The purpose of the drilling fluid is to, among other things, remove the earthen cuttings resulting from the drilling process.

Weight-on-bit (hereinafter WOB) is generally recognized as being an important parameter in controlling the drilling of a well. The weight is applied to the bit by a string of heavy drill collars that is attached immediately above the bit and suspended in the borehole on smaller diameter drill pipe. In conventional drilling practice, the entire length of the drill pipe and an upper portion of the drill collar string are suspended at the surface from the derrick in tension, so that the amount of WOB can be varied by changing the indicated surface hookload. Properly controlled WOB is necessary to optimize the rate that the bit penetrates a particular type of earth formation, as well as the rate of bit wear. WOB also is utilized in controlling the direction of the hole, and accurate measurement thereof can be used in analyzing drilling rate "breaks" indicative of entry of the bit into more porous earth formations. Thus, precise and accurate measurements of the WOB parameter may be important in the drilling process. Torque also is an important measure useful in estimating the degree of wear on the bit, particularly when considered together with measurements of WOB.

In the past, WOB measurements have sometimes been made at the surface by comparing indicated hookload weight to off-bottom weight of the drill string. However, surface measurement of WOB is not always reliable due to the drag of the drill string on the borehole wall, and other factors.

In other cases, a strain gauge bridge positioned in a downhole tool has been used to obtain various data, including WOB measurement data. During drilling operations, there is a pressure difference between the internal pressure within the drill pipe and the external pressure in the well bore annulus between the drill pipe and the well bore. This pressure differential may be quite large, e.g., on the order of approximately 200–800 psi for a typical well. A large percentage of pressure differential is due to the pressure drop as the drilling fluid circulates throughout the drill bit. The downhole pressures result in strains that act in the same sense as the axial strains associated with the WOB, thereby creating the possibility that the strains associated with the downhole pressures can be misinterpreted as reflecting WOB values. While the differential pressure may be on the order of 200–850 psi, the overall pressure may be as high as approximately 10,000 psi. Pressures of this magnitude may cause massive errors in WOB measurements.

At least theoretically, the strains induced by the downhole pressures can be compensated for by various pressure correction factors that are based upon various calculations. However, there are several drawbacks to such a methodology. For example, if the strains from the downhole pressures are combined with the strains from the WOB, the overall strain values that may be obtained are much higher than the strain value for the WOB alone. In turn, this requires that a data acquisition system used to obtain such strain data must have a relatively larger analog input range, thereby resulting in a lower resolution of the strain values of interest. Second, if the internal and external pressures are not measured, or at least not accurately measured, it is very difficult to accurately apply pressure correction factors. Moreover, such pressure correction factors have inherent inaccuracies that, all other things being equal, would preferably be avoided.

The present invention is directed to an apparatus and methods that may solve, or at least reduce, some or all of the aforementioned problems.

SUMMARY OF INVENTION

The present invention is generally directed to a tool for obtain weight-on-bit (WOB) measurements and methods of using such a tool. In one illustrative embodiment the tool comprises a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge operatively coupled to the mounting face above the region of approximately zero axial strain.

In another illustrative embodiment, the method comprises providing a weight-on-bit measurement tool comprised of a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge coupled to the mounting face above the region of approximately zero axial strain. The method further comprises positioning the tool in a drill string comprised of a drill bit, drilling a well bore with the drill string, and obtaining weight-on-bit measurement data using the weight-on-bit strain gauge in the tool.

In a further illustrative embodiment, the method comprises identifying a region of approximately zero axial strain due to downhole pressures for a body to be positioned in a drill string when the body is subjected to downhole pressures during drilling operations, providing a strain gauge cavity in the body such that a strain gauge mounting face within the cavity is located at a position wherein the region of approximately zero axial strain exists on the mounting face when the body is subjected to downhole pressures during drilling operations, and coupling a weight-on-bit strain gauge to the mounting face above the region of approximately zero axial strain.

BRIEF DESCRIPTION OF DRAWINGS

The invention may be understood by reference to the following description taken in conjunction with the accompanying drawings, in which like reference numerals identify like elements.

Figure 1:
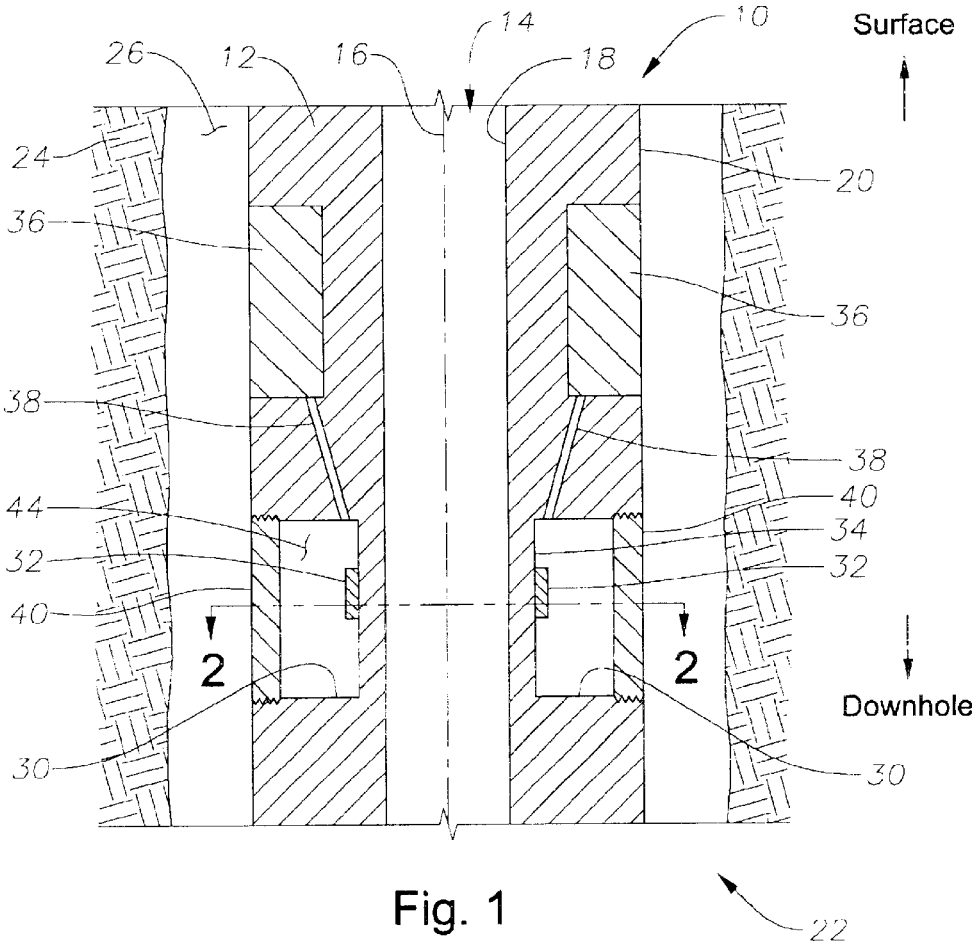
FIG. 1 is a partial cross-sectional side view of a downhole tool in accordance with one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will, of course, be appreciated that in the development of any such actual embodiment, numerous implementation-specific decisions must be made to achieve the developers" specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached drawings which are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
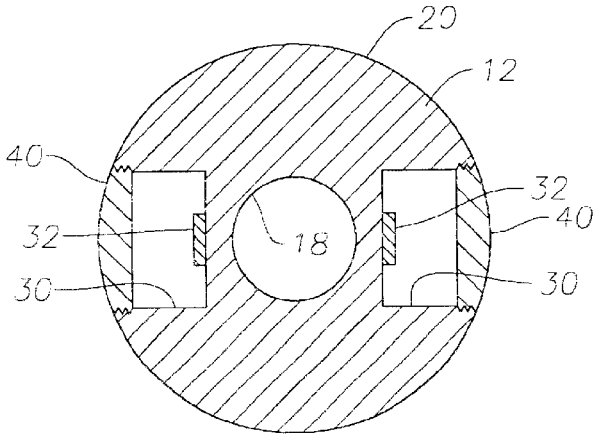
FIG. 2 is a cross-sectional plan view of a downhole tool in accordance with one illustrative embodiment of the present invention.

The present invention will now be initially described with reference to FIGS. 1 and 2. As depicted therein, a downhole tool 10 is comprised of a body 12, an internal bore 14, having a longitudinal centerline 16, an inner surface 18 and an outer surface 20. As depicted in FIG. 1, the tool 10 is adapted to be positioned in a well bore 22 formed in the earth 24. A well bore annulus 26 is defined between the outer surface 20 of the body 12 and the earth 24. During drilling operations, drilling fluid (or "mud") is circulated down through the internal bore 14, out a drill bit (not shown) and returned to the surface via the annulus 26.

In the illustrative embodiment depicted in FIG. 1, the tool 10 is further comprised of a plurality of strain gauge cavities 30. A schematically depicted strain gauge 32 is mounted on a strain gauge mounting face 34 in each of the cavities 30. The strain gauge 32 is adapted to provide WOB data, and it is part of a strain gauge bridge (not shown) positioned within the cavity 30. Such strain gauge bridges are well known to those skilled in the relevant art, and, thus, will not be depicted or discussed in any further detail so as not to obscure the present invention. As indicated in FIG. 2, in one illustrative embodiment, the tool 10 is comprised of two cavities 30 that are positioned approximately 180 degrees apart from one another on approximately opposite sides of the body 12 and located at approximately the same vertical height. Also depicted in FIG. 1 is an electronics compartment 36 where data from the strain gauges 32 may be transmitted and stored, processed or otherwise analyzed by various devices. Typically, the electronics compartment 36 will contain a data acquisition system (not shown) that may be useful in acquiring and manipulating data obtained from the strain gauge 32 positioned within the cavity 30. Wire paths 38 are provided to allow proper wiring of the strain gauges 32 to components in the electronics compartment 36.

Also depicted in FIG. 1 is a protective cover 40 for each of the cavities 30. In one illustrative embodiment, the covers 40 may be threadingly coupled to the cavity 30 and a seal may be provided by a seal ring (not shown). As thus configured, an air pocket 44 is defined by the internal surfaces of the cavity 30 and the cover 40. However, the present invention is not limited to the cavity 30 and cover 40 configuration depicted in FIG. 1. That is, as will be described further in the application, the embodiment depicted in FIG. 1 is but one illustrative example of a cavity 30 and cover 40 that may be employed with the present invention.

Figure 3A:
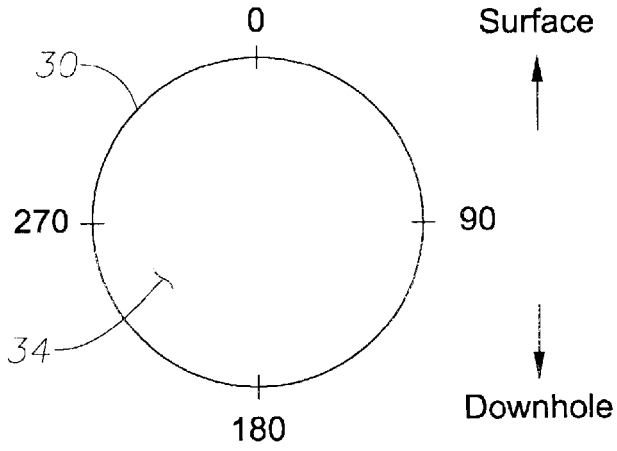
FIGS. 3A–3B are a front and a cross-sectional side view, respectively, of one illustrative embodiment of a strain gauge cavity that may be employed with the present invention.
Figure 3B:
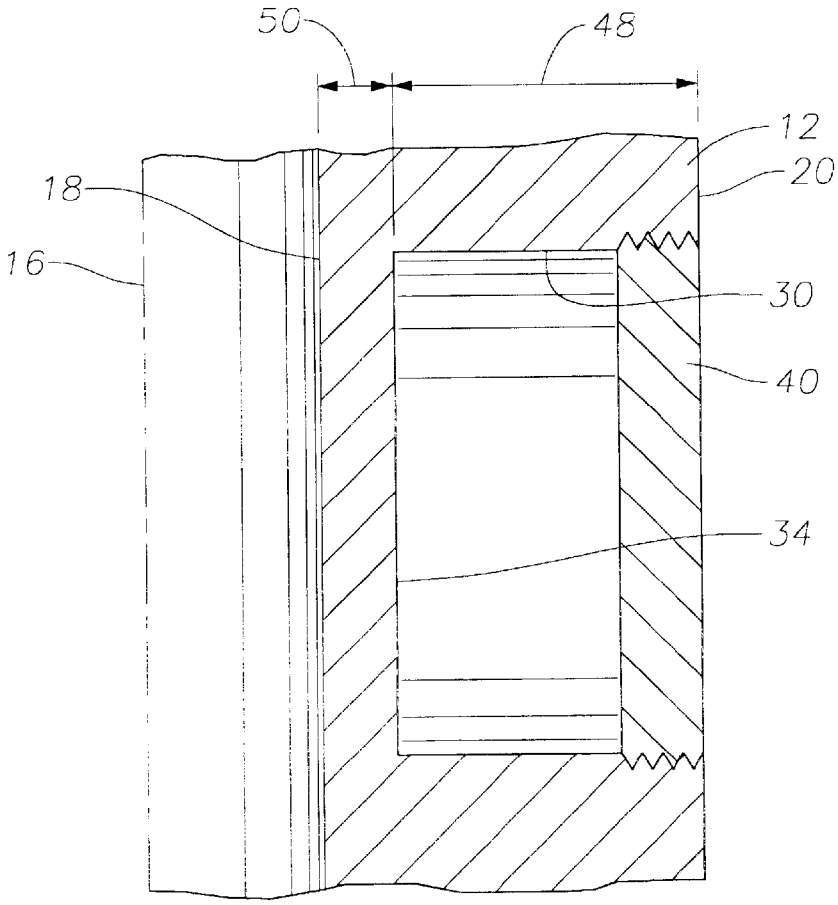

FIGS. 3A–3B are provided to provide further details with respect to one illustrative embodiment of the present invention. More specifically, FIG. 3A is a front view of an illustrative strain gauge cavity 30 in accordance with one illustrative embodiment of the present invention, and FIG. 3B is an enlarged, partial cross-sectional view of such an illustrative cavity 30. In the embodiment depicted therein, the cavity 30 has a circular cross-sectional configuration. However, after a complete reading of the present application, those skilled in the art will understand that the cavity 30 may be formed to any desired shape. Thus, the present invention should not be considered as limited to cavities 30 having a circular configuration unless such limitations are clearly set forth in the appended claims. Moreover, the size of the cavity 30 may also vary depending upon the particular application. In one illustrative embodiment for a tool with a 6.25" outside diameter, the cavity 30 has a diameter of approximately 1½" and a depth 48 of approximately 1⅛", although such dimensions may vary depending on the particular application. For ease of reference, the labels 0°, 90°, 180°and 270° have been added to FIG. 3A, which is a frontal view of the cavity 30. The longitudinal centerline 16 of the tool 10 runs approximately parallel to the 0°–180°line depicted in FIG. 3A, with 0° representing the surface or uphole direction and 180°representing the downhole direction.

In general, the present invention involves locating the strain gauge mounting face 34 of the strain gauge cavity 30 at a position where a line or region of approximately zero axial strain is present on the mounting face 34 of the cavity 30 when the tool 10 is subjected to downhole pressures during operation. The position of the mounting face 34 at which a line or region of approximately zero axial strain will exist on the mounting face 34 will vary depending upon the particular application. More specifically, the distance 50 between the inner surface 18 of the body 12 and the mounting surface 34 will vary depending upon the particular application. A variety of factors, such as the internal pressure within the internal bore 14, the external pressure in the well bore annulus 26, the pressure difference between the internal and external pressures, the mechanical configuration of the tool 10, the mechanical configuration of the cavity 30, the material from which the body 12 is made, and the pressure within the cavity 30, etc., may have an impact regarding the location in the body 12 where a line or region of approximately zero axial strain occurs.

Determining the correct position at which to locate the mounting face 34 such that a line or region of approximately zero axial strain exists on the mounting face 34 may involve analysis of the various stresses and strains produced on the body 12 under anticipated loading conditions. Such analytical techniques may involve finite element analysis and/or computational analysis techniques that are well known to those skilled in the art. Typically, such a stress/strain analysis may be performed to generate a strain diagram that depicts a range of strain values, both positive and negative, within the body 12. At some point, a location in the body 12 will be identified wherein the strain diagram indicates that a region of approximately zero axial strain will occur at that location when the tool 10 is subjected to downhole pressures during drilling operations. For example, with reference to FIG. 3B, the analysis will result in a strain diagram wherein, at a radial distance 50, a region of approximately zero axial strain will exist within the body 12 on the mounting face 34 of the cavity 30. The strain diagram from the analysis will typically identify a range of axial strain values, plus and minus, that will exist on the mounting face 34 during operating conditions. Once this strain diagram is obtained, the strain pattern may be laid out or otherwise identified on the mounting face 34 of the tool 10. Then, as described more fully below, the strain gauge 32 is operatively coupled to the mounting face 34 above at least the region of approximately zero axial strain.

Figure 4:
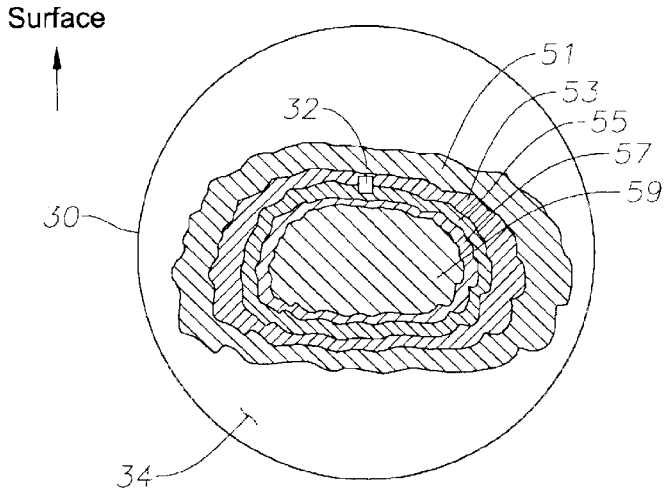
FIG. 4 is a strain plot depicting one illustrative embodiment wherein a WOB strain gauge is positioned in the strain gauge cavity above a region of approximately zero strain.

FIG. 4 depicts an illustrative strain diagram superimposed on the mounting face 34 of the cavity 30. The strain diagram reflects axial strains from the combined loadings due to anticipated downhole pressures wherein the location of the mounting surface 34 within the body 12 is selected such that a line or area of approximately zero axial strain is present on the mounting face 34. More specifically, in FIG. 4, the strain diagram reflects the situation where the cavity 30 is at approximately atmospheric pressure and there is an internal pressure of approximately 5000 psi (within the internal bore 14) and an external pressure (in the annulus 26) of approximately 4000 psi, for a pressure differential of approximately 1000 psi. In the illustrative embodiment depicted in FIG. 4, there are five regions or areas 51, 53, 55, 57 and 59 that reflect different axial strain values, ranging from the highest (in a relative sense) negative strain values in region 59 to the highest positive strain values in region 51. For simplicity and ease of explanation, only five such regions are indicated in FIG. 4. Moreover, the regions 51, 53, 55, 57 and 59 may be somewhat exaggerated in size, as compared to such regions in practice, for ease of explanation. In practice, depending upon the level of detail obtained from the stress analysis, there may be many such regions identified. In the example depicted in FIG. 4, the region 53 indicates positive strain values ranging from 0 to +2 e−6, while the region 55 indicates negative strain values ranging from 0 to −2 e−6. Thus, in this illustrative example, the line or region of approximately zero axial strain would actually be at the interface between the regions 53 and 55. As indicated in FIG. 4, the WOB strain gauge 32 is positioned above at least the area or region of approximately zero axial strain. Any of a variety of commercially available strain gauges may be employed as the WOB strain gauge 32 as long as it is properly positioned and operatively coupled to the mounting face 34, which is also properly located based upon the stress analysis. The strain gauge 32 may be mounted to the mounting face 34 by any of a variety of known techniques, e.g., spot-welding, gluing, bonding, etc.

In general, the strain gauge 32 should be positioned as close as practical to the region of approximately zero axial strain. However, in practicing the present invention, due to the physical size of the strain gauges 32 and the size of the areas of approximately zero axial strain, it may be difficult to precisely locate the strain gauge such that it is actually positioned only on a region of zero axial strain. When the strain gauge 32 is operatively coupled to the mounting face 34, the strain gauge 32 may actually extend into areas on the mounting face 34 that have slightly positive or negative values of strain. Simply put, according to one embodiment of the present invention, the strain gauge 32 should be positioned as close as practical to the area on the mounting face 34 that exhibits zero axial strain due to the anticipated downhole pressure conditions when the tool 10 is in service.

By identifying the region of approximately zero axial strain, and locating the strain gauges at that position, the strains due to pressure do not adversely impact the WOB measurements, or at least such impact is greatly reduced. Stated another way, the strains due to pressure may be approximately zeroed out by properly locating the mounting face 34 within the body 12, and positioning the strain gauge 32 at that location. A strain gauge 32 would also be positioned in the cavity 30 on the opposite side of the tool 10 such that strains due to bending are effectively cancelled out.

Figure 5:
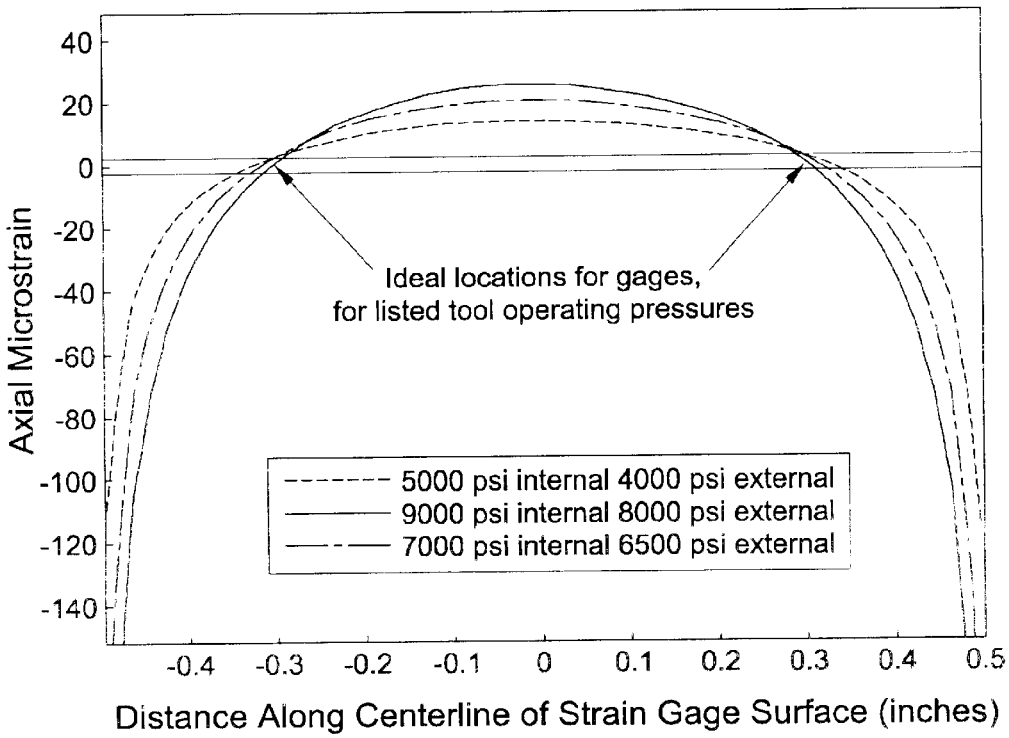
FIG. 5 is a graph depicting axial strain levels at different positions along the strain gauge surface.

In one illustrative aspect, the present invention may be optimized to work best at a particular ratio of external pressure and internal pressure, e.g., 4000 psi/5000 psi. Such a design would work equally as well at other pressures, as long as the ratio of the applied pressures is approximately the same, e.g., 2000 psi external/2500 psi internal pressure. In general, the WOB measurement provided in accordance with the present invention should be relatively insensitive to the overall pressure (combined loading) on the tool. Since the pressure drop through the bit is relatively small and more consistent compared to overall loading of the tool, a tool in accordance with the present invention may generally be effective in varying conditions. Attached as FIG. 5 is a diagram that is useful in describing the usefulness of the present invention. As shown therein, FIG. 5 depicts the overall level of axial strain (vertical axis) due to the combined pressure loads. Three pressure loads, which would be typical of drilling conditions, are shown in FIG. 5. The graph shows that all of the pressure loads have a point where the axial strain is approximately zero. The points of approximately zero axial strain do not overlap precisely for all of the various loading combinations. However, for each individual loading condition, the point of approximately zero axial strain may be more precisely identified. More importantly, even in the case where multiple loadings are experienced, by locating the strain gauges at the regions of approximately zero axial strain for most, if not all, anticipated loading conditions, pressure-induced errors in WOB measurements may be reduced relative to the errors that would be introduced if the strain gauges were positioned in a haphazard or random manner without regard to the pressure-induced axial strains that will exist on the strain gauge mounting face 34.

Figure 6:
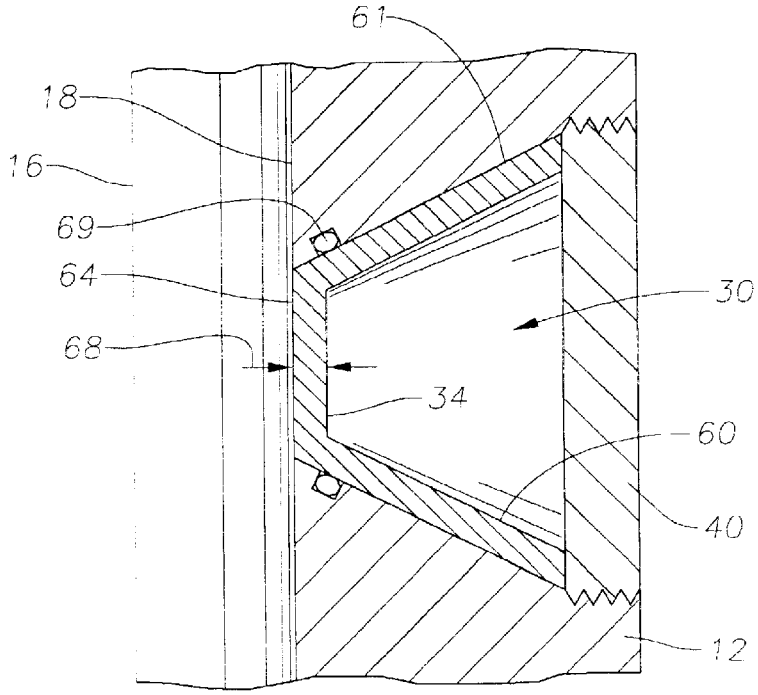
FIG. 6 depicts an alternative embodiment of a strain gauge cavity that may be employed with the present invention.

FIG. 6 depicts an alternative embodiment of the present invention wherein the strain gauge cavity 30 may be defined by use of a cavity insert 60. As depicted therein, the cavity insert 60 is a separate device that may be positioned in an opening 61 formed in the body 12 of the tool 10. In the depicted embodiment, the cavity insert 60 has a generally conical configuration and it has a surface 64 that is adapted to be approximately flush with the inner surface 18 of the body 12 when installation is complete. The cavity insert 60 has a strain gauge mounting face 34 that is positioned and located as described above. In the depicted embodiment, the cavity insert 60 is secured within the body 12 by the protective cap 40, which is threadingly engaged with the body 12. A seal 69 is positioned between the cavity insert 60 and the body 12. As described previously, the thickness 68 of the bottom portion of the cavity insert 60 is controlled such that, for its intended application, an area of approximately zero axial strain exists on the mounting face 34.

Figure 7:
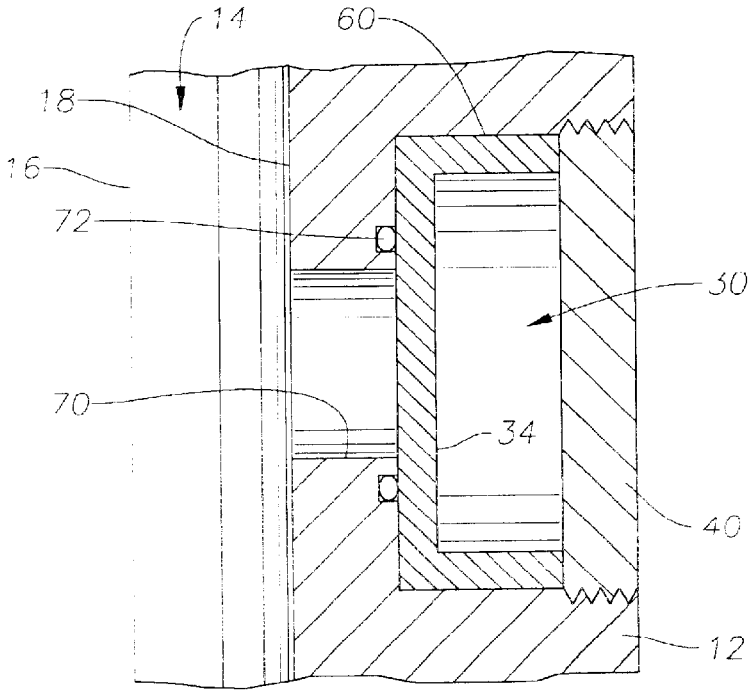
FIG. 7 depicts another alternative embodiment of a strain gauge cavity that may be employed with the present invention.

FIG. 7 depicts yet another illustrative embodiment of a cavity 30 in accordance with the present invention. As shown therein, the cavity insert 60 has a generally cylindrical configuration and a strain gauge mounting face 34. The cavity insert 60 is secured in place by the cover 40 that is threadingly coupled to the body 12. In this illustrative embodiment, a passageway 70 is provided in the body 12 between the cavity insert 60 and the inner bore 14 of the tool 10. The passageway 70 may, in one embodiment, be a hole having a diameter that may vary from approximately 0.125–1.0 inches depending upon the particular application. A seal 72 is provided between the cavity insert 60 and the body 12. In this embodiment, the passageway 70 is provided to insure that the internal pressure within the bore 14 acts on the cavity insert 60. As with other embodiments, the cavity insert 60 depicted in FIG. 7 is sized and positioned such that the strain gauge mounting face 34 is located at a position such that a line or region of approximately zero axial strain exists on the mounting face 34 when the tool 10 is subjected to downhole pressures during drilling.

In the embodiments depicted herein, the strain gauge cavities 30 are designed and configured such that an air pocket 44 is provided in the cavities 30. However, those skilled in the art will recognize that the present invention may be employed in situations where the cavity 30 is flooded with an appropriate inert fluid, and a diaphragm (not shown) is employed instead of the cover 40. Such configurations are well known to those skilled in the art and, thus, will not be described in any further detail. In some cases, it may be desirable to employ such a flooded cavity 30 design to properly locate the strain gauge mounting face 34 at an appropriate position within the body 12. However, it should be understood that if a flooded cavity design is adapted, the size, location and configuration of the design may need to be significantly redesigned due to the reduce differential pressure between the mounting face 34 of the strain gauge 32 and the internal bore 14.

The body 12 may take on a variety of configurations and it may or may not be symmetrical through its entire axial length. If the body is asymmetrical, that factor may have to be accounted for in determining the location of the mounting face 34 in a particular region of the tool 10 as compared to other regions. The body 12 may be comprised of a variety of materials, e.g., an austenitic stainless steel, such as NMS 140, a carbon steel, such as Type 4340 carbon steel, titanium, etc. Moreover, the body 12 may be made from a forging or it may simply be a section of pipe. The cavities 30 disclosed herein may be located at any location along the axial length of the drill string. Normally, the cavities 30, and strain gauges 32 therein, will be positioned as close as practical to the drill bit such that the gauges 32 more accurately reflect the true WOB. For example, the drill string may be configured in a bit tool drill collar arrangement, a bit tool downhole motor arrangement, or a bit tool rotary steerable tool arrangement. The present invention may be employed with vertical wells or deviated wells.

The data obtained from the strain gauges 32 located within the tool 10 in accordance with the present invention may be employed in a number of ways. For example, the data obtained by the strain gauge 32 may simply be stored in a data acquisition system (not shown) positioned in the electronics compartment 36, or it may be provided on a real-time basis to the drilling operators via any of a variety of known telemetry systems or techniques. In the case where multiple wells are to be drilled in a relatively small region, it may be sufficient to simply use the WOB data from the strain gauge 32 to assist in planning or designing the drilling operations on subsequently drilled wells. In the situation where real-time data is supplied to the drilling operators, the WOB data may actually be employed to control the WOB as the well is being drilled.

The present invention is generally directed to a tool for obtaining weight-on-bit (WOB) measurements and methods of using such a tool. In one illustrative embodiment the tool comprises a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge operatively coupled to the mounting face above the region of approximately zero axial strain.

In another illustrative embodiment, the tool comprises a body, at least two strain gauge cavities in the body, each of the strain gauge cavities having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge operatively coupled to the mounting face above the region of approximately zero axial strain.

In yet another illustrative embodiment, the method comprises providing a weight-on-bit measurement tool comprised of a body, at least one strain gauge cavity in the body, the strain gauge cavity having a strain gauge mounting surface that is located at a position such that a region of approximately zero axial strain due to downhole pressures during drilling operations exists on the mounting surface when the tool is subjected to downhole pressures during drilling operations, and a weight-on-bit strain gauge coupled to the mounting face above the region of approximately zero axial strain. The method further comprises positioning the tool in a drill string comprised of a drill bit, drilling a well bore with the drill string, and obtaining weight-on-bit measurement data using the weight-on-bit strain gauge in the tool.

In a further illustrative embodiment, the method comprises identifying a region of approximately zero axial strain due to downhole pressures for a body to be positioned in a drill string when the body is subjected to downhole pressures during drilling operations, providing a strain gauge cavity in the body such that a strain gauge mounting face is located at a position wherein the region of approximately zero axial strain exists on the mounting face when the body is subjected to downhole pressures during drilling operations, and coupling a weight-on-bit strain gauge on the mounting face above the region of approximately zero axial strain.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A weight-on-bit measurement tool, comprising:

a body;

at least one strain gauge cavity in said body, said strain gauge cavity having a strain gauge mounting surface that is located at a position such that a region of approximately zero axial strain due to downhole pressures during drilling operations exists on said mounting surface when said tool is subjected to said downhole pressures during drilling operations; and a weight-on-bit strain gauge operatively coupled to said mounting face above said region of approximately zero axial strain.

2. The tool of claim 1, further comprising a cover plate positioned in an opening of said cavity.

3. The tool of claim 2, wherein said cover plate and said cavity define a chamber substantially free of liquids.

4. The tool of claim 2, wherein said cavity defines a space that is filled with a liquid.

5. The tool of claim 1, wherein said cavity has a circular cross-sectional configuration.

6. The tool of claim 1, wherein said tool is comprised of at least one of stainless steel, a carbon steel and titanium.

7. The tool of claim 1, wherein said cavity has a circular cross-sectional configuration of a diameter of approximately 1½" and said mounting face is positioned at a depth of approximately 1⅛" below an outer surface of said body.

8. The tool of claim 1, wherein said cavity is formed in said body.

9. The tool of claim 1, wherein said cavity is defined, at least partially, by a cavity insert positioned in said body.

10. The tool of claim 9, further comprising an internal passageway formed between an internal bore of said body and said cavity insert.

11. The tool of claim 9, wherein at least a portion of said cavity insert has a conical configuration.

12. A weight-on-bit measurement tool, comprising:

a body;

at least two strain gauge cavities in said body, each of said strain gauge cavities having a strain gauge mounting surface that is located at a position such that a region of approximately zero axial strain due to downhole pressures during drilling operations exists on said mounting surface when said tool is subjected to said downhole pressures during drilling operations; and a weight-on-bit strain gauge operatively coupled to said mounting face above said region of approximately zero axial strain.

13. The tool of claim 12, wherein said cavities are positioned on opposite sides of said tool body.

14. The tool of claim 12, further comprising a cover plate positioned in an opening of each of said cavities.

15. The tool of claim 14, wherein said cover plate and each of said cavities define a chamber substantially free of liquids.

16. The tool of claim 14, wherein each of said cavities a space that is filled with a liquid.

17. The tool of claim 12, wherein each of said cavities have a circular cross-sectional configuration.

18. The tool of claim 12, wherein said tool is comprised of at least one of stainless steel, a carbon steel and titanium.

19. The tool of claim 12, wherein each of said cavities have a circular cross-sectional configuration of a diameter of approximately 1½" and said mounting face is positioned at a depth of approximately 1⅛" below an outer surface of said body.

20. The tool of claim 12, wherein each of said cavities are formed in said body.

21. The tool of claim 12, wherein each of said cavities are defined, at least partially, by a cavity insert positioned in said body.

22. The tool of claim 21, further comprising an internal passageway formed between an internal bore of said body and said cavity insert.

23. The tool of claim 21, wherein at least a portion of said cavity insert has a conical configuration.

24. A method, comprising:

providing a weight-on-bit measurement tool comprised of:

a body;

at least one strain gauge cavity in said body, said strain gauge cavity having a strain gauge mounting surface that is located at a position such that a region of approximately zero axial strain due to downhole pressures during drilling operations exists on said mounting surface when said tool is subjected to said downhole pressures during drilling operations; and a weight-on-bit strain gauge operatively coupled to said mounting face above said region of approximately zero axial strain;

positioning said tool in a drill string comprised of a drill bit;

drilling a well bore with said drill string; and obtaining weight-on-bit measurement data using said weight-on-bit strain gauge in said tool.

25. The method of claim 24, wherein said weight-on-bit measurement data is provided on a real-time basis.

26. The method of claim 24, wherein said weight-on-bit measurement data is provided on a non-real-time basis.

27. The method of claim 24, further comprising a cover plate positioned in an opening of said cavity.

28. The method of claim 27, wherein said cover plate and said cavity define a chamber substantially free of liquids.

29. The method of claim 27, wherein said cavity defines a space that is filled with a liquid.

30. The method of claim 24, wherein said cavity has a circular cross-sectional configuration.

31. The method of claim 24, wherein said tool is comprised of at least one of stainless steel, a carbon steel and titanium.

32. The method of claim 24, wherein said cavity has a circular cross-sectional configuration of a diameter of approximately 1½" and said mounting face is positioned at a depth of approximately 1⅛" below an outer surface of said body.

33. The method of claim 24, wherein said cavity is formed in said body.

34. The method of claim 24, wherein said cavity is defined, at least partially, by a cavity insert positioned in said body.

35. The method of claim 34, further comprising an internal passageway formed between an internal bore of said body and said cavity insert.

36. The method of claim 34, wherein at least a portion of said cavity insert has a conical configuration.

37. A method, comprising:

identifying a region of approximately zero axial strain due to downhole pressures for a body to be positioned in a drill string when said body is subjected to downhole pressures during drilling operations;

providing a strain gauge cavity in said body such that a strain gauge mounting face within said cavity is located at a position wherein said region of approximately zero axial strain exists on said mounting face when said body is subjected to said downhole pressures during said drilling operations; and coupling a weight-on-bit strain gauge to said mounting face above said region of approximately zero axial strain.

38. The method of claim 37, wherein providing a strain gauge cavity in said body comprises machining a cavity in said body.

39. The method of claim 37, wherein providing a strain gauge cavity in said body comprises forming an opening in said body and positioning a cavity insert in said opening.

40. The method of claim 37, further comprising a cover plate positioned in an opening of said cavity.

41. The method of claim 37, wherein said cover plate and said cavity define a chamber substantially free of liquids.

42. The method of claim 37, wherein said cavity defines a space that is filled with a liquid.

43. The method of claim 37, wherein said cavity has a circular cross-sectional configuration.

44. The method of claim 37, wherein said tool is comprised of at least one of stainless steel, a carbon steel and titanium.

45. The method of claim 37, wherein said cavity has a circular cross-sectional configuration of a diameter of approximately 1½" and said mounting face is positioned at a depth of approximately 1⅛" below an outer surface of said body.

46. The method of claim 37, wherein said cavity is formed in said body.

47. The method of claim 37, wherein said cavity is defined, at least partially, by a cavity insert positioned in said body.

48. The method of claim 47, further comprising an internal passageway formed between an internal bore of said body and said cavity insert.

49. The method of claim 47, wherein at least a portion of said cavity insert has a conical configuration.

* * * * *